US009010754B2

(12) United States Patent
Matsumoto

(10) Patent No.: US 9,010,754 B2
(45) Date of Patent: Apr. 21, 2015

(54) POST-PROCESSING DEVICE AND IMAGE FORMING SYSTEM

(71) Applicant: Fuji Xerox Co., Ltd., Tokyo (JP)

(72) Inventor: Masashi Matsumoto, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/892,817

(22) Filed: May 13, 2013

(65) Prior Publication Data

US 2014/0167350 A1 Jun. 19, 2014

(30) Foreign Application Priority Data

Dec. 13, 2012 (JP) ..... 2012-272314

(51) Int. Cl.
*B65H 31/04* (2006.01)
*B65H 31/34* (2006.01)
*G03G 15/00* (2006.01)

(52) U.S. Cl.
CPC ..... *B65H 31/34* (2013.01); *B65H 2301/4213* (2013.01); *B65H 2801/27* (2013.01); *G03G 15/6538* (2013.01)

(58) Field of Classification Search
CPC ... B65H 31/04; B65H 31/10; B65H 2408/114
USPC ..... 271/213, 214, 220–224; 270/52.08, 270/58.12, 58.16, 58.17, 58.27
See application file for complete search history.

(56) References Cited

U.S. PATENT DOCUMENTS

| | | | | |
|---|---|---|---|---|
| 5,147,092 | A * | 9/1992 | Driscoll et al. | 271/184 |
| 6,145,825 | A | 11/2000 | Kunihiro et al. | |
| 7,726,639 | B2 * | 6/2010 | Sato | 270/58.04 |
| 7,887,051 | B2 * | 2/2011 | Hirokawa et al. | 271/220 |
| 8,162,306 | B2 * | 4/2012 | Suzuki et al. | 270/58.12 |
| 8,430,399 | B1 * | 4/2013 | Huang et al. | 271/171 |

FOREIGN PATENT DOCUMENTS

JP B2-3748710 2/2006

* cited by examiner

*Primary Examiner* — Michael McCullough
(74) *Attorney, Agent, or Firm* — Oliff PLC

(57) ABSTRACT

A post-processing device includes: a stacking section that stacks a sheet; an output section that outputs the sheet stacked on the stacking section; a facing section that is arranged to face an end portion of the stacked sheet on an upstream side in an output direction; a movable support section that is provided to be movable from the stacking section toward a downstream side in the output direction of the stacked sheet, and when the stacked sheet is outputted from the stacking section, supports the stacked sheet with the stacking section; and a pressing section that is provided in the movable support section to face an end portion of the stacked sheet on the downstream side in the output direction, and presses the stacked sheet against the facing section with movement of the movable support section.

18 Claims, 7 Drawing Sheets

POST-PROCESSING DEVICE AND IMAGE FORMING SYSTEM

CROSS REFERENCE TO RELATED APPLICATIONS

This application is based on and claims priority under 35 USC §119 from Japanese Patent Application No. 2012-272314 filed Dec. 13, 2012.

BACKGROUND

1. Technical Field

The present invention relates to a post-processing device and an image forming system.

2. Related Art

Many sheet processing devices are known in which various types of sheet aligning functions are provided.

SUMMARY

According to an aspect of the present invention, there is provided a post-processing device including: a stacking section that stacks a sheet; an output section that outputs the sheet stacked on the stacking section; a facing section that is arranged to face an end portion of the stacked sheet on an upstream side in an output direction; a movable support section that is provided to be movable from the stacking section toward a downstream side in the output direction of the stacked sheet, and when the stacked sheet is outputted from the stacking section, supports the stacked sheet with the stacking section; and a pressing section that is provided in the movable support section to face an end portion of the stacked sheet on the downstream side in the output direction, and presses the stacked sheet against the facing section with movement of the movable support section.

BRIEF DESCRIPTION OF THE DRAWINGS

An exemplary embodiment of the present invention will be described in detail based on the following figures, wherein.

DETAILED DESCRIPTION

Hereinafter, an exemplary embodiment according to the present invention will be described in detail with reference to the attached drawings.

<Sheet Processing System 1>

Figure 1:
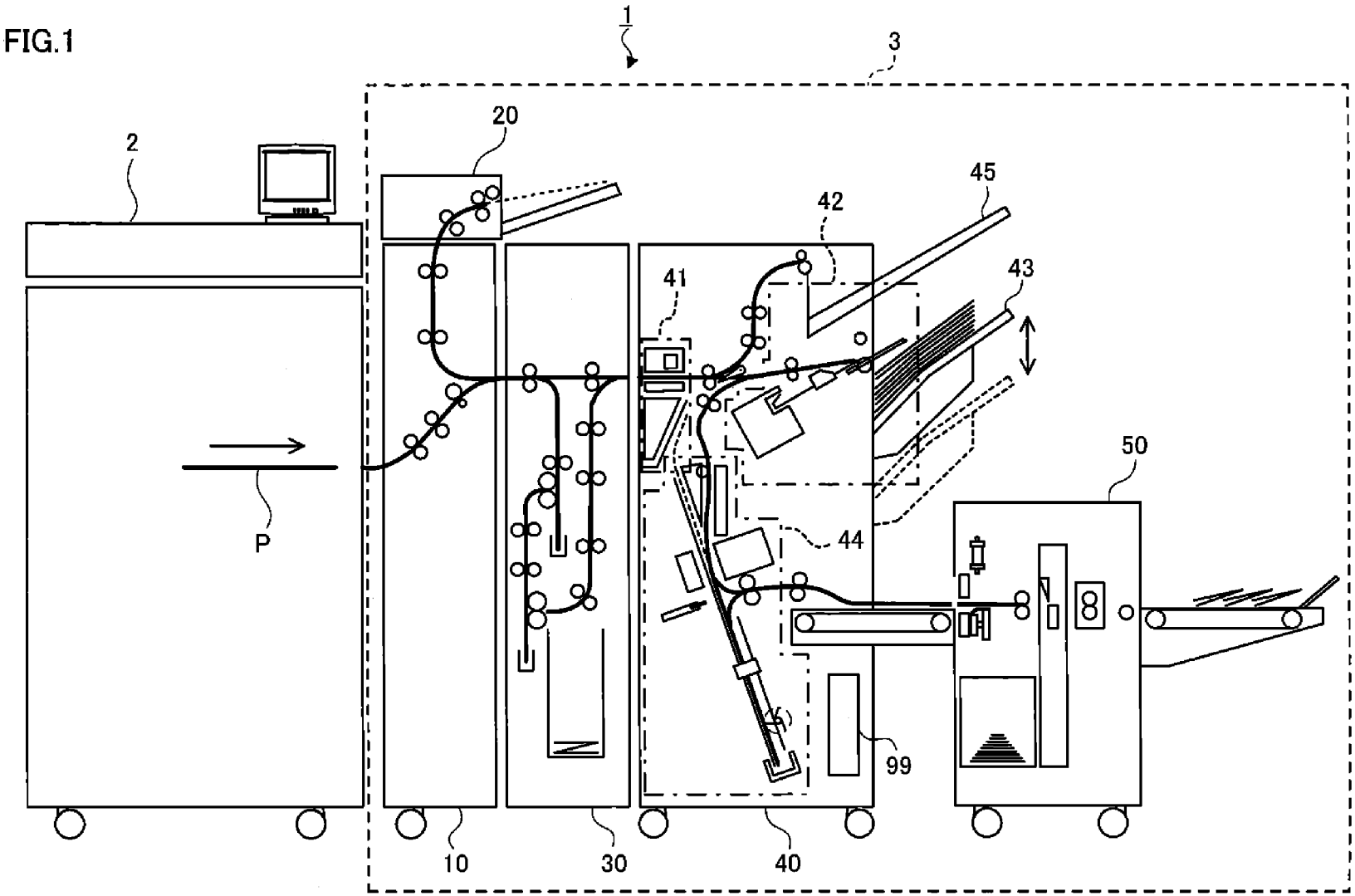
FIG. 1 is a diagram showing an entire configuration of a sheet processing system to which the exemplary embodiment is applied.

FIG. 1 is a diagram showing an entire configuration of a sheet processing system (image forming system) 1 to which the exemplary embodiment is applied.

The sheet processing system 1 shown in FIG. 1 includes an image forming apparatus (image forming section) 2 that forms a color toner image on a sheet P by the electrophotographic method, for example, and a sheet processing apparatus 3 that applies predetermined processes on the sheet P on which the toner image has been formed by the image forming apparatus 2. It should be noted that, in the exemplary embodiment, the image forming apparatus 2 that forms an image by the electrophotographic method is shown as an example; however, the image forming apparatus 2 may be configured with, for example, an ink jet printer.

The sheet processing apparatus 3 includes a transport device 10 that further transports the sheet P outputted from the image forming apparatus 2 to the downstream side and an interleaf supply device 20 that supplies an interleaf such as a thick sheet and a window sheet to the sheet (bundle of sheets) P transported by the transport device 10. The sheet processing apparatus 3 also includes a folding device 30 that performs a folding process, such as an inside three-folding (C-folding) and an outside three-folding (Z-folding), on the sheet P transported from the transport device 10 and a first post-processing device 40 that is provided at a downstream side of the folding device 30 and performs punching, end-stitching or saddle-stitching on the sheet P. The sheet processing apparatus 3 further includes a second post-processing device 50 that is provided at a downstream side of the first post-processing device 40 and performs further processing on the bundle of sheets P (booklet) having been subjected to the processes of center folding and saddle-stitching. Moreover, the sheet processing apparatus 3 is provided with a controller 99 that is configured with a program-controlled CPU (central processing unit) to control the entire sheet processing apparatus 3.

<First Post-Processing Device 40>

As shown in FIG. 1, the first post-processing device 40 includes: a punching unit 41 that performs hole-making (punching) on the sheet P and an end-stitching unit 42 that performs stitching on an end portion of the bundle of sheets (stacked sheets) P; a first stacking portion 43 for stacking the bundle of sheets P, which is end-stitched, so that a user can easily pick up the bundle of sheets P; and a saddle-stitching unit 44 that performs the processes of center folding and saddle-stitching on the bundle of sheets P to provide a booklet of a double-page spread. Further, the first post-processing device 40 includes a second stacking portion 45 that stacks sheets P that are not subjected to any process in the first post-processing device 40 or sheets P having been subjected to the punching process only.

Figure 2:
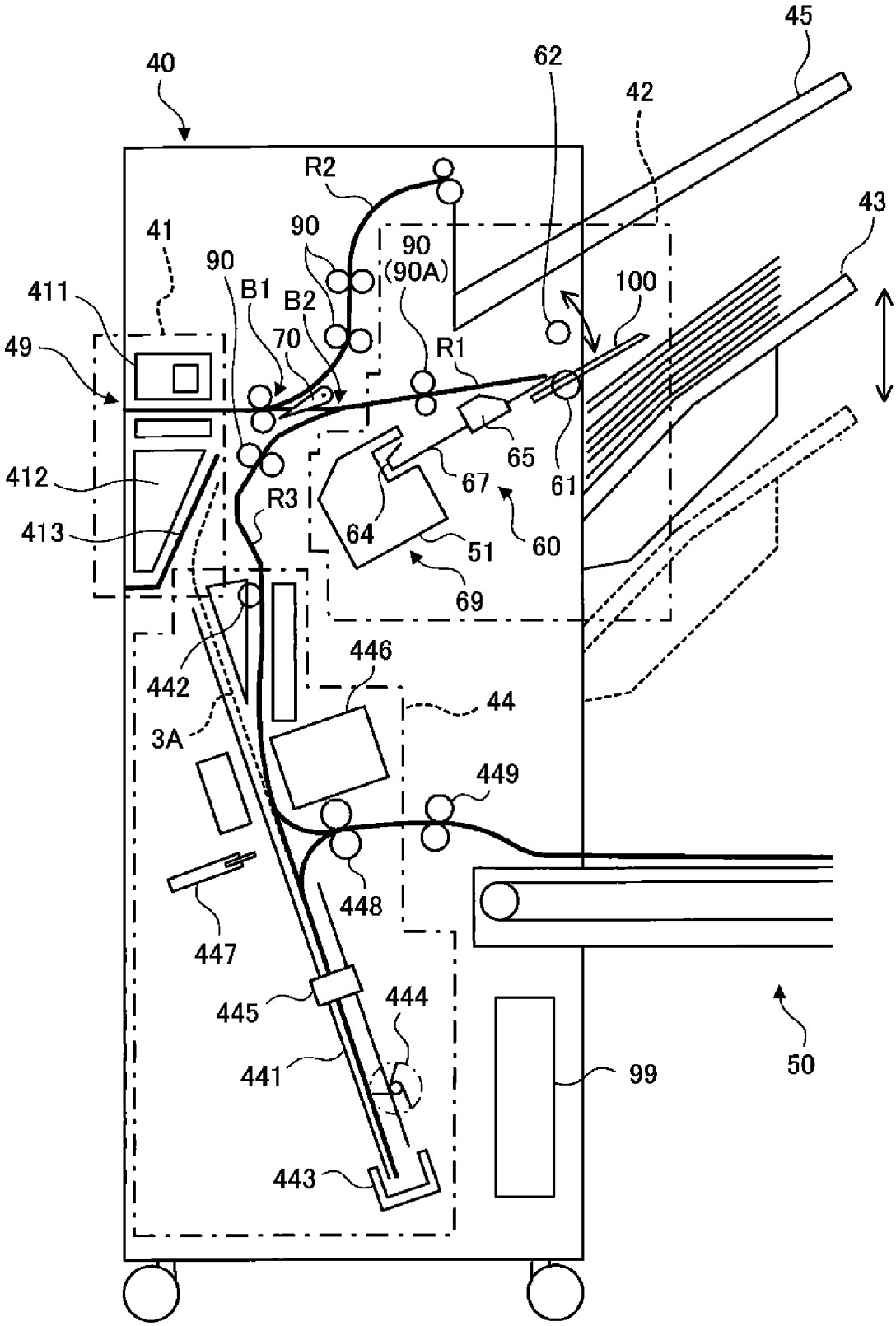
FIG. 2 is a diagram for illustrating a configuration of a first post-processing device.

FIG. 2 is a diagram for illustrating a configuration of the first post-processing device 40.

As shown in FIG. 2, the first post-processing device 40 includes a receiving port 49 that receives the sheet P transported from the folding device 30 (refer to FIG. 1). The first post-processing device 40 also includes a first sheet transport route R1 that is provided to extend from the receiving port 49 to the end-stitching unit 42 to be used for transporting the sheet P received at the receiving port 49 toward the end-stitching unit 42.

Further, the first post-processing device 40 is provided with a second sheet transport route R2 that branches off at a first branch portion B1 from the first sheet transport route R1 to be used for transporting the sheet P toward the second stacking portion 45. Still further, the first post-processing device 40 is provided with a third sheet transport route R3 that branches off at a second branch portion B2 from the first sheet transport route R1 to be used for transporting the sheet P toward the saddle-stitching unit 44. It should be noted that, in the exemplary embodiment, the second branch portion B2 is positioned below the first branch portion B1 in a transport direction of the sheet P in the first sheet transport route R1.

In the exemplary embodiment, a switch gate 70, which is arranged between the first branch portion B1 and the second branch portion B2 to switch (set) the route of transporting the sheet P to any of the first sheet transport route R1 to the third sheet transport route R3, is provided. Moreover, each of the first sheet transport route R1 to the third sheet transport route R3 is provided with a transport roll (transport section) 90 that is configured with a pair of roll-like members to drive rotationally for transporting the sheet P on the sheet transport route.

<Punching Unit 41>

Next, the punching unit 41 will be described.

Here, the punching unit 41 is provided beside the receiving port 49 and performs hole making (punching) of two holes, four holes and so forth on the sheet P having been transported to the first post-processing device 40. Here, the punching unit 41 includes a unit main body 411 that includes a punching blade and performs punching of two holes, four holes and so forth on the sheet P and a container 412 arranged beneath the unit main body 411 to contain punched chips generated in the punching process by the unit main body 411. Moreover, the punching unit 41 includes a partition wall 413 that is arranged between the inside of the first post-processing device 40 and the container 412 to separate the portion where the container 412 is located and the inside of the first post-processing device 40.

Next, the end-stitching unit 42 will be described.

The end-stitching unit 42 includes a sheet stacker 60 that stacks the necessary number of sheets P to generate the bundle of sheets P and a stitching process unit 69 that performs staple-stitching (end-stitching) on the end portion of the bundle of sheets P generated by the sheet stacker 60.

The end-stitching unit 42 also includes: a sheet width position aligning member 65 for aligning a position of the bundle of sheets P in the width direction; a transport roll 61 that is used for transporting (outputting) the bundle of sheets P generated by the sheet stacker 60 toward the first stacking portion 43; and a movable roll 62 that is movable to a position to be retracted from the transport roll 61 and a position to be in pressure contact with the transport roll 61 (output section).

Further, the end-stitching unit 42 includes a shelf mechanism 100 that supports the bundle of sheets P and the sheet stacker 60 when the bundle of sheets P is transported from the sheet stacker 60 to the first stacking portion 43. It should be noted that the shelf mechanism 100 has a function of aligning the position of the bundle of sheets P generated by the sheet stacker 60 in the transport direction (to be described in detail later).

Here, the sheet stacker 60 includes a support plate (stacking section) 67 that is arranged with inclination to support the sheet P from beneath and an end guide (facing section) 64 that is attached to the end portion of the support plate 67 such that a leading edge (an end portion on an upstream side in the output direction) of the sheet P falling along the support plate 67 reaches thereto. In other words, in the specific example shown in the figure, the end guide 64 is attached to the end portion of the support plate 67 to extend upwardly in the figure. Moreover, the support plate 67 in which an end portion closer to the first stacking portion 43 along the transport direction of the bundle of sheets P is positioned above the other end portion, as shown in the figure, and the end guide 64 may be grasped as a stacking section of an uphill type.

The stitching process unit 69 is provided with a stapler head 51, and the stapler head 51 performs staple-stitching by pressing a metal-made staple (U-shaped needle) into the bundle of sheets P. The stapler head 51 is provided to be movable to the back side and the front side of the device in the figure, and is configured to be capable of performing the stitching process on the sheet P at plural locations.

At the time when the process by the end-stitching unit 42 is performed, first, the sheet P transported from the folding device 30 (refer to FIG. 1) is received at the receiving port 49. Thereafter, the sheet P is transported along the first sheet transport route R1 and reaches the end-stitching unit 42. Then, the sheet P is transported over the support plate 67 and falls onto the support plate 67. The sheet P moves by sliding on the support plate 67 by inclination assigned to the support plate 67 while being supported from beneath by the support plate 67.

Thereafter, the sheet P is caused to reach the end guide 64 of the support plate 67 and is stopped. Then the sheet P is pressed by the sheet width position aligning member 65 and the shelf mechanism 100, and thereby the position of the sheet P (bundle of sheets P) on the support plate 67 is aligned. Hereinafter, this operation is performed every time the sheet P is transported from the upstream side onto the support plate 67, and thereby the bundle of sheets P, which is the aligned sheets P, is generated on the support plate 67.

When the sheets P of a predetermined number are stacked on the support plate 67, staple-stitching on the end portion of the bundle of sheets P is performed by the stapler head 51 of the stitching process unit 69. Thereafter, the movable roll 62 moves toward the transport roll 61, and the bundle of sheets P is sandwiched by the movable roll 62 and the transport roll 61. Then, the transport roll 61 drives rotationally to transport the bundle of sheets P to the first stacking portion 43 while the bundle of sheets P is supported by the shelf mechanism 100.

<Saddle-Stitching Unit 44>

Next, the saddle-stitching unit 44 will be described.

As shown in FIG. 2, the saddle-stitching unit 44 includes: a sheet stacker 441 that is arranged with inclination to the vertical direction and stacks a necessary number of sheets P after image formation; an output roll 442 that outputs the sheet P transported via the third sheet transport route R3 to the sheet stacker 441; and an end guide 443 that moves along the sheet stacker 441 for determining the saddle-stitching position or the center folding position. The saddle-stitching unit 44 also includes plural sheet aligning members 444 that transport the sheets P stacked on the sheet stacker 441 toward the end guide 443. In the specific example shown in the figure, each of the sheet aligning members 444 is configured with rotating paddles.

Moreover, the saddle-stitching unit 44 includes a sheet width aligning member 445 configured with a pair of matching plates that moves by sliding for aligning the sheets P stacked on the sheet stacker 441 in the width direction and a stapler 446 that performs saddle-stitching on the bundle of sheets P stacked on the sheet stacker 441. The saddle-stitching unit 44 further includes: a folder knife 447 that advances from the back surface side toward the front surface side of the sheet stacker 441 for folding the bundle of sheets P having been saddle-stitched by the stapler 446 at the saddle-stitching position; a folder roll 448 configured with a pair of rolls that nips the bundle of sheets P on which folding is started by the folder knife 447; and a transport roll 449 that transports the bundle of sheets P nipped by the folder roll 448 toward the second post-processing device 50.

In the case where a booklet subjected to center folding and saddle stitching is to be formed by the first post-processing device 40, first, the sheet P is received at the receiving port 49, and the sheet P is transported along the first sheet transport route R1 until a trailing edge of the sheet P reaches the switch gate 70. It should be noted that, at this time, the switch gate 70 is arranged to guide the sheet P to the first sheet transport route R1 (end-stitching unit 42). Then, after the trailing edge of the sheet P reaches the switch gate 70, transportation of the sheet P is temporarily halted.

Thereafter, the switch gate 70 is driven to press the trailing edge of the sheet P from the lateral direction, and thereby the trailing edge of the sheet P enters into the third sheet transport route R3. Then, reverse rotation of the transport roll 90 (transport roll indicated by the sign 90A in the figure) is started. Accordingly, transportation of the sheet P along the third sheet transport route R3 is started, and the sheet P is forwarded to the output roll 442 provided in the saddle-stitching unit 44. Thereafter, the sheet P is sent away to the sheet stacker 441 by the output roll 442. Hereinafter, every time a new sheet P is transported, these operations are repeated.

Consequently, the sheets of the number such as 5, 10, and so forth, set by, for example, a controller (not shown) in the image forming apparatus 2 are stacked at the sheet stacker 441. It should be noted that, when the sheets P are stacked at the sheet stacker 441, the sheet aligning members 444 rotate and press the sheets P to be stacked against the end guide 443 to assist sheet alignment. In addition, the sheet width aligning member 445 moves by sliding along the width direction of the sheets P to be stacked on the sheet stacker 441 and performs sheet alignment on the stacked sheets P from the width direction.

Here, though depending upon the size of the sheet P, after the sheets P of a predetermined number are stacked on the sheet stacker 441, the end guide 443 moves upwardly and the center portion of the sheets P (bundle of sheets P) in the transport direction is located to the stapling position by the stapler 446. At this time, the bundle of sheets P is elevated along the sheet stacker 441 with the upward movement of the end guide 443; however, if the bundle of sheets P is long in the length direction thereof, the bundle of sheets P is forwarded along the broken line 3A in the figure.

It should be noted that, in this case, there is a possibility that the leading edge of the bundle of sheets P reaches the punching unit 41 and movement of the bundle of sheets P is restricted. However, in the exemplary embodiment, the bundle of sheets P is guided to a route beside the punching unit 41 by the partition wall 413 provided to the punching unit 41, and accordingly, movement of the bundle of sheets P is not restricted. It should be noted that it may be possible to omit the partition wall 413 and to guide the bundle of sheets P to the route beside the punching unit 41 by a side surface of the container 412.

When the center portion of the sheet P reaches the stapling position by the stapler 446, saddle stitching for part of the sheet P (for example, the center portion) is performed by the stapler 446. Subsequently, the bundle of sheets P, on which the saddle stitching is completed, is moved such that the folded portion thereof (for example, the center portion of the sheet P in the sheet transport direction) coincides with a tip end position of the folder knife 447 by downward movement of the end guide 443. It should be noted that the folder knife 447 is retracted behind the sheet stacker 441 in the stage of stacking the sheets to the sheet stacker 441, the stage of saddle stitching by the stapler 446 and the stage of transporting the sheets after performing saddle stitching.

After the folded portion of the bundle of sheets P is moved to the tip end position of the folder knife 447, the folder knife 447 is pushed from the back surface side toward the front surface side of the sheet stacker 441. This causes the folder knife 447 to be projected to the front surface side of the sheet stacker 441 through an aperture (not shown) formed in the sheet stacker 441. Then, according to this projection, the center portion of the bundle of sheets P is pushed out toward the folder roll 448, and is nipped by the folder roll 448. Thereafter, the bundle of sheets P is transported to the downstream side by the folder roll 448, and the bundle of sheets P is passed to the transport roll 449. Then, the bundle of sheets P, to which the center folding and saddle-stitching processes are applied, is forwarded to the second post-processing device 50 by the transport roll 449.

It should be noted that the case where the stitching process by the end-stitching unit 42 and center folding and saddle stitching by the saddle-stitching unit 44 are performed is described above; however, the sheets P on which these two processes are not performed or the sheets P on which only the punching process by the punching unit 41 is performed are guided to the second sheet transport route R2 by the switch gate 70, and are stacked on the second stacking portion 45.

<Shelf Mechanism 100>

Figure 3:
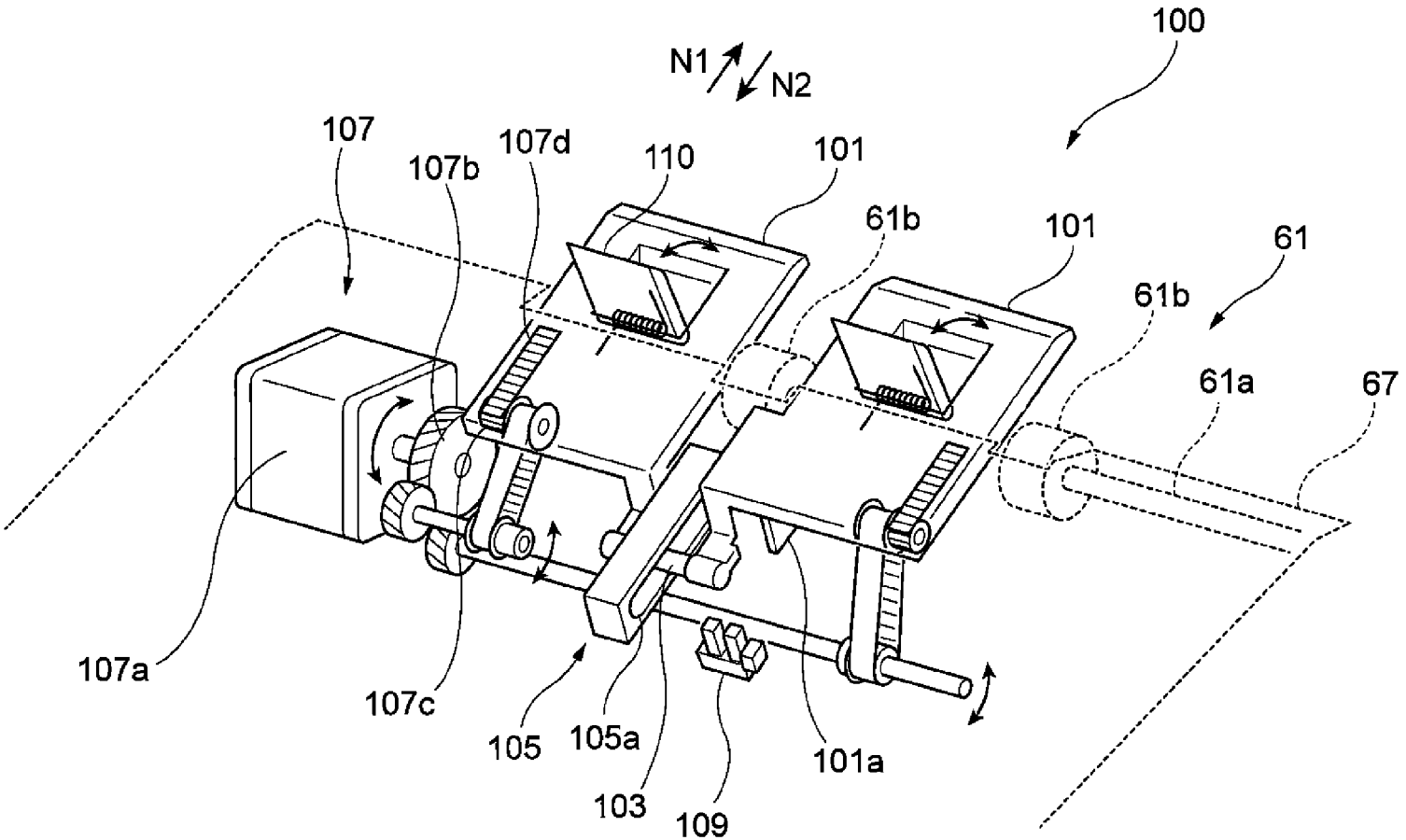
FIG. 3 is a diagram for illustrating a shelf mechanism.

FIG. 3 is a diagram for illustrating the shelf mechanism 100.

The shelf mechanism, which is an example of a pressing unit, is a guide for supporting the sheet P (bundle of sheets P) on the support plate 67 together with the support plate 67. The shelf mechanism 100 includes: plural shelves 101 provided in the direction intersecting the transport direction of the sheet P; connectors 103 that connect the shelves 101; a guide portion 105 that guides the connector 103; a driving unit 107 that drives the shelves 101; and a sensor 109 that detects a home position of each of the shelves 101. In addition, the shelf mechanism 100 of the exemplary embodiment includes a claw portion 110 that is provided in each of the shelves 101 and is arranged to be projected onto a transport route through which the bundle of sheets P is transported (outputted) from the support plate 67 to the first stacking portion 43.

The shelf 101, which is an example of a movable support section, is a plate member arranged along the transport route of the bundle of sheets P and includes a top surface (stacking surface) for supporting the sheet P to be outputted from beneath. In the specific example shown in the figure, two shelves 101 that are separated in the direction intersecting the transport direction of the bundle of sheets P are provided. To be described further, the shelves 101 are arranged in the direction intersecting the transport direction of the bundle of sheets P alternately with two contact portions 61*b* provided in a rotational axis 61*a* of the transport roll 61. A detected portion 101*a* to be detected by the sensor 109 is provided beneath one of the shelves 101. As will be described later, the shelf 101 is provided to be movable from the support plate 67 along the transport direction (output direction) of the bundle of sheets P (refer to arrows N1 and N2 in the figure). It should be noted that the shelf 101 in the specific example shown in the figure is a flat plate member, but may be configured to be curved along the transport direction of the bundle of sheets P, for example.

The connector 103 is a member for connecting the shelves 101 separated in the direction intersecting the transport direction of the bundle of sheets P, and in the specific example shown in the figure, the connector 103 is formed as a cylindrical member provided such that the axial direction thereof is along the direction intersecting the transport direction of the bundle of sheets P.

The guide portion 105 has a penetration groove 105*a* provided such that the longitudinal direction thereof is along the direction in which the shelf 101 moves (directions of arrows N1 and N2 in the figure). The moving direction of the shelf 101 driven by the driving unit 107 is restricted by the connector 103 arranged in the penetration groove 105*a*.

The driving unit 107 includes: a shelf motor 107*a*, which is a stepping motor for driving the shelf 101; a shelf gear group

107*b* that rotates by receiving drive from the shelf motor 107*a*; a pinion gear 107*c* that rotates by receiving drive from the shelf gear group 107*b*; and a rack gear 107*d* that receives drive from the pinion gear 107*c*.

The sensor 109, in the specific example shown in the figure, is configured with a photosensor provided at a position facing the detected portion 101*a* of the shelf 101 located at the home position.

Next, with reference to FIGS. 3 and 4, configuration of the claw portions 110 will be described. It should be noted that FIG. 4 is a diagram for illustrating the claw portion 110.

Figure 4:
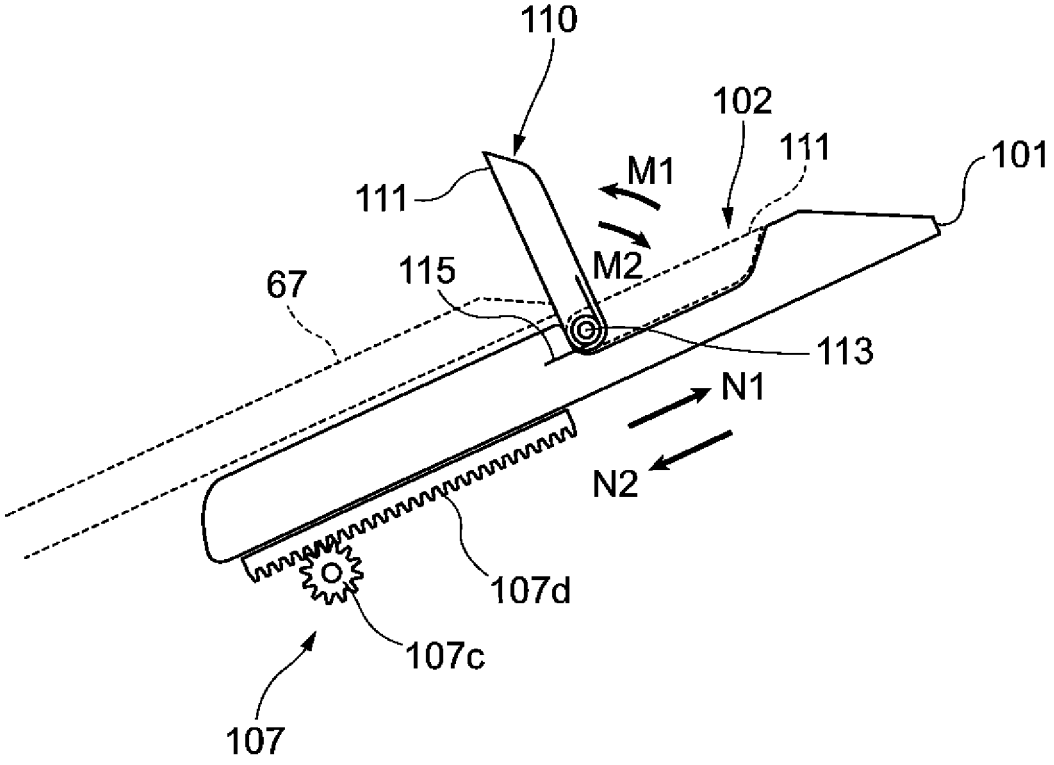
FIG. 4 is a diagram for illustrating a claw portion.

The claw portion 110, which is an example of a pressing section, includes: a claw portion main body 111 that is a plate-like member provided on the top surface of the shelf 101 and is provided to be projectable and retractable with respect to the transport route of the bundle of sheets P; a rotational axis 113 that is provided at one end portion of the claw portion main body 111 in the transport direction of the bundle of sheets P to urge the claw portion 111 to be rotatable with respect to the shelf 101; and a torsion spring 115 that is provided in the proximity of the rotational axis 113 and causes the claw portion main body 111 in a predetermined direction with respect to the rotational axis 113 (counter-clockwise direction in FIG. 4).

Here, though description is omitted above, the shelf 101 is provided with a recessed portion 102 capable of containing the claw portion 110 inside thereof. In the specific example shown in the figure, the recessed portion 102 has a shape corresponding to the shelf 101, and in a state where the claw portion main body 111 is arranged inside the recessed portion 102, the top surface of the claw portion main body 111 is along (or on a same level) as the top surface of the shelf 101. This prevents the bundle of sheets P from being caught by the recessed portion 102 when the bundle of sheets P is to be outputted. It should be noted that the recessed portion 102 may be grasped as a storage section of the claw portion 110.

As described above, the claw portion main body 111 is provided to be projectable and retractable with respect to the transport route of the bundle of sheets P. Specifically, the claw portion main body 111 rotates around the rotational axis 113 (refer to arrows M1 and M2 in the figure), to thereby switch between a standing attitude and a lying attitude relative to the shelf 101. To be described further, the claw portion main body 111 rotates between a state of being arranged to project into the transport route of the bundle of sheets P (refer to the claw portion main body 111 indicated by a solid line in FIG. 4) and a state of being arranged to be stored in the recessed portion 102 of the shelf 101 and retracted from the transport route of the bundle of sheets P (refer to the claw portion main body 111 indicated by a broken line in FIG. 4). In addition, when retracting from the transport route of the bundle of sheets P, the claw portion main body 111 is retracted from the transport route of the bundle of sheets P while rotating in a direction of separating from the support plate 67.

Here, the torsion spring 115, which is an example of a retracting mechanism and an urging section, is configured to have an elastic force capable of causing the claw portion 111 in the standing attitude from the shelf 101 to press the supplied sheet P downwardly along the support plate 67. In addition, the torsion spring 115 is configured to have an elastic force capable of causing the shelf 101 to be pressed by the support plate 67 to rotate in the direction of separating from the support plate 67 (refer to arrow M2 in the figure) when the shelf 101 moves along the direction N2. Further, the torsion spring 115 is configured to have an elastic force capable of causing the claw portion main body 111 to rotate in the direction of separating from the bundle of sheets P (refer to arrow M2 in the figure) by being pushed by the bundle of sheets P when the bundle of sheets P subjected to the stitching process is transported (outputted).

It should be noted that, as shown in FIG. 3, in the specific example shown in the figure, each of the two shelves 101 has the claw portion main body 111. The plural claw portion main bodies 111 may be provided at intervals in the direction intersecting the sheet transport direction for suppressing skew of the sheet P (bundle of sheets P); however, there may be a configuration with a single claw portion main body 111. Moreover, in the specific example shown in the figure, the single claw portion main body 111 is provided along the transport direction of the sheets P; however, for example, there may be a configuration in which the plural claw portion main bodies 111 are provided along the transport direction of the sheets P for aligning the sheets P of plural sizes supplied to the support plate 67.

<Operations of Shelf 101 and Claw Portion 110>

Next, with reference to FIGS. 5A to 5C and 6A to 6C, operations of the shelf 101 and the claw portion 110 will be described. It should be noted that FIGS. 5A to 5C are diagrams for illustrating operations of the shelf 101 and the claw portion 110, and FIGS. 6A to 6C are diagrams for illustrating operations of the shelf 101 and the claw portion 110 when sheets are supplied.

First, the shelf 101 changes the position thereof between a state of being arranged (stored) below the support plate 67 (refer to FIG. 5A) and a state of being projected from the support plate 67 (refer to FIGS. 5B and 5C) by moving along the directions N1 and N2 in the figure upon receiving a drive from the driving unit 107. In other words, the shelf 101 may be grasped as, so to speak, a mechanism for temporarily extending the support plate 67 toward the downstream side in the transport direction of the sheets P. In addition, by temporarily extending the support plate 67, it becomes possible to downsize the support plate 67, and as a result, downsize the first post-processing device 40.

Figure 5A:
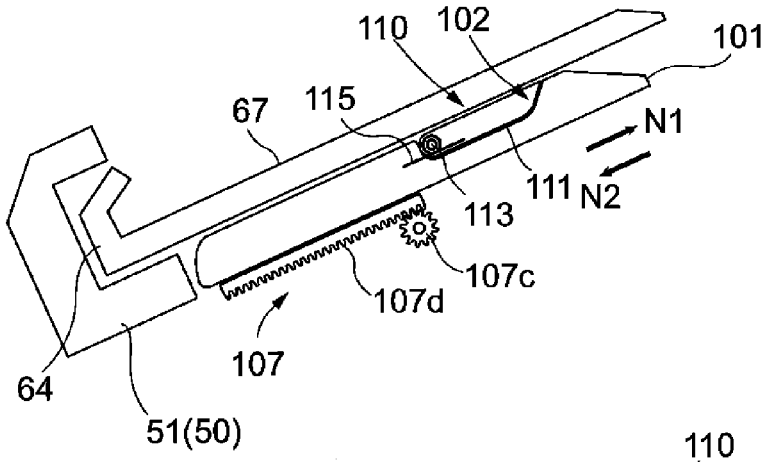
FIGS. 5A to 5C are diagrams for illustrating operations of a shelf and the claw portion.
Figure 6A:
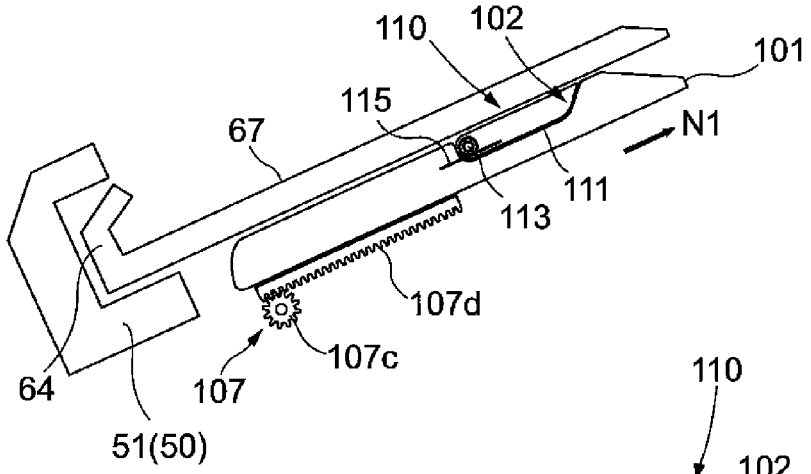
FIGS. 6A to 6C are diagrams for illustrating operations of the shelf and the claw portion when sheets are supplied.
Figure 6B:
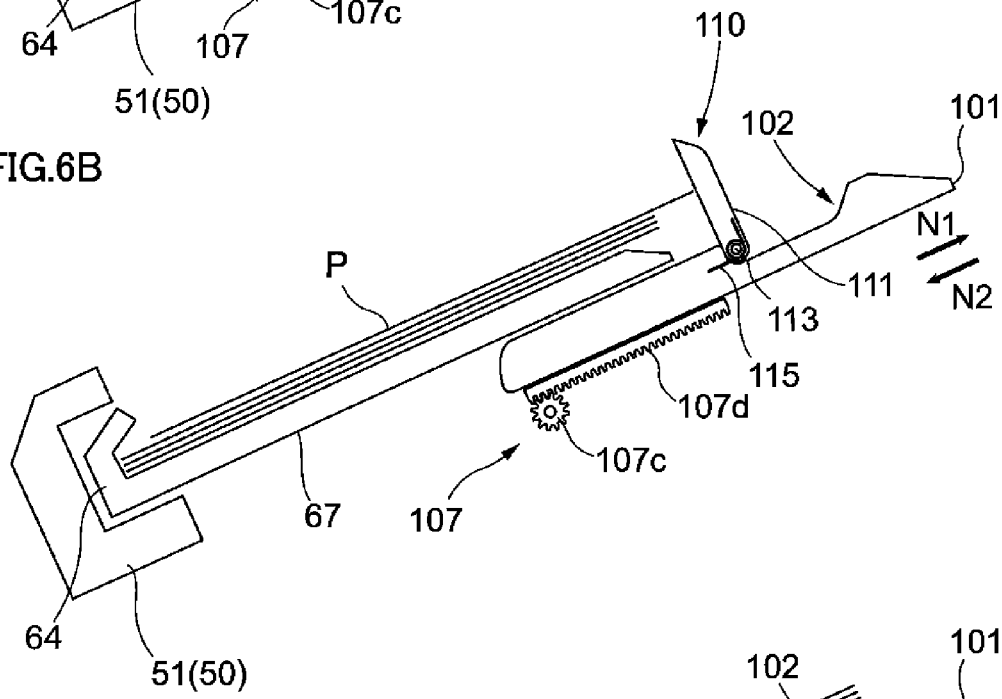
Figure 6C:
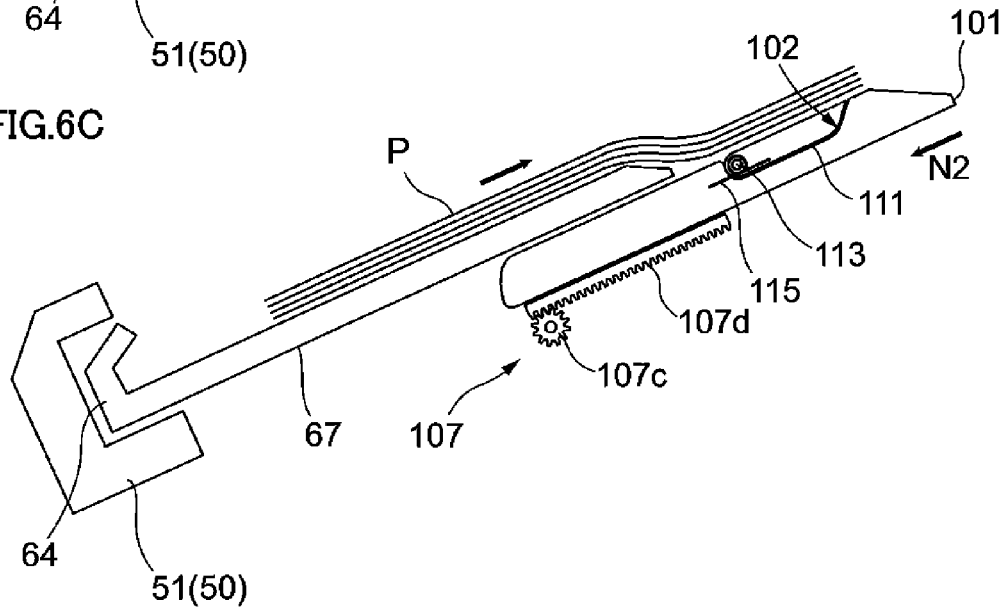

As shown in FIG. 5A, in the state where the shelf 101 is stored below the support plate 67 (home position), an end portion of the shelf 101 opposite to the stapler head 51 side is drawn below the support plate 67. The claw portion main body 111 is brought into a state of being stored in the recessed portion 102 of the shelf 101. Specifically, since the claw portion main body 111 is stored in the recessed portion 102 of the shelf 101, it becomes possible to draw the shelf 101 and the claw portion main body 111 below the support plate 67 without causing the claw portion main body 111 to be caught. Moreover, the claw portion main body 111 stored in the recessed portion 102 is in a state of trying to stand up by the elastic force of the torsion spring 115, but being prevented by the support plate 67.

Figure 5B:
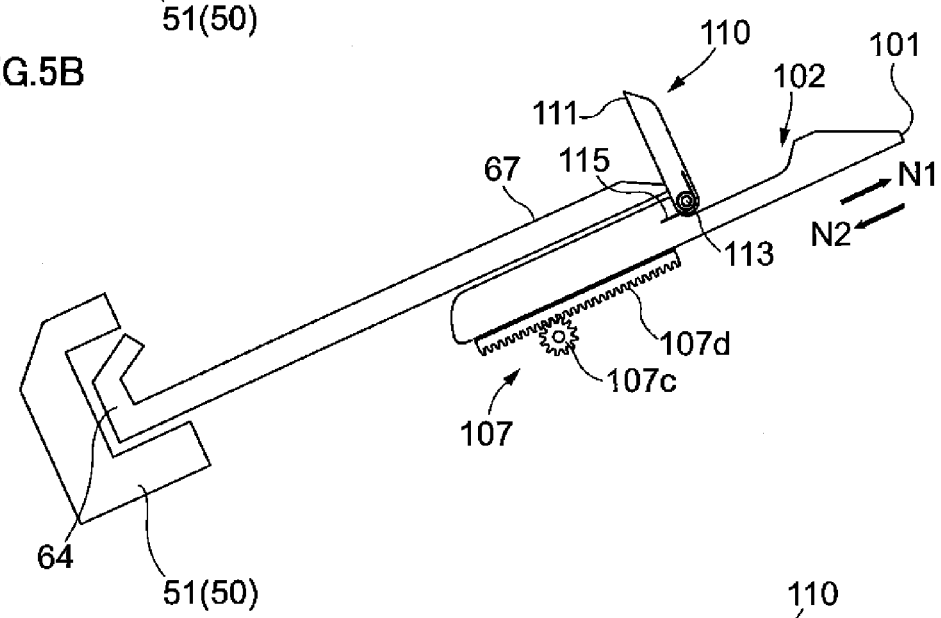
Figure 5C:
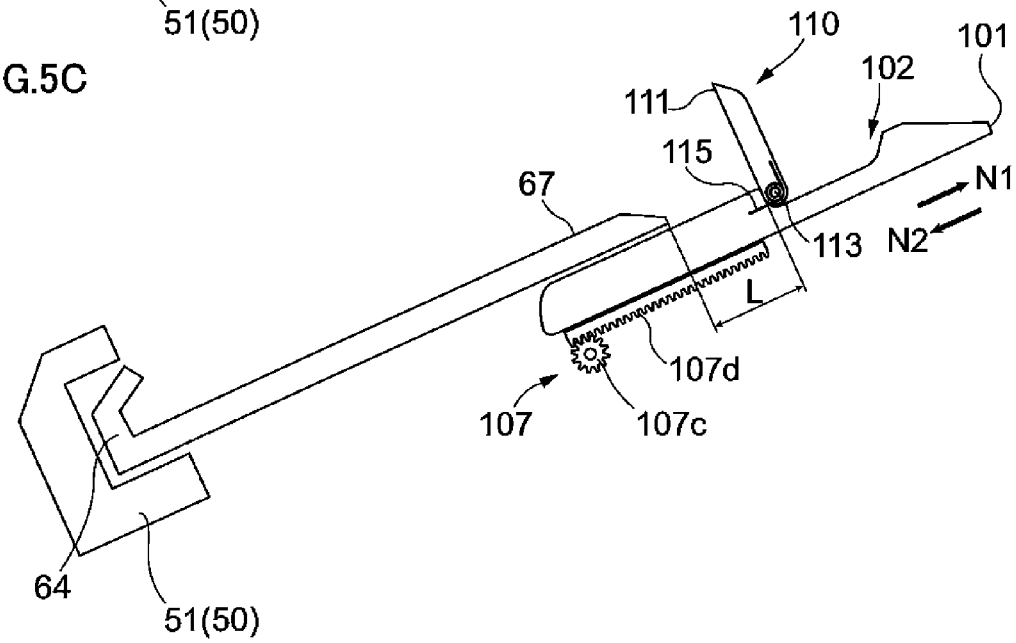

On the other hand, as shown in FIGS. 5B and 5C, in the state where the shelf 101 and the claw portion main body 111 project from the support plate 67, the claw portion main body 111 adopts the standing attitude due to the elastic force of the torsion spring 115 without being prevented by the support plate 67. When the claw portion main body 111 is in the standing attitude, with the movement for a distance L along the transport direction of the bundle of sheets P, the shelf 101 changes the position thereof between a first position where the claw portion main body 111 is close to the tip end of the support plate 67 (refer to FIG. 5B) and a second position where the standing claw portion main body 111 is separated from the tip end of the support plate 67 (refer to FIG. 5C).

Incidentally, as shown in FIG. 6A, when the post-processing device 40 starts the post-processing operation on the sheets P, the shelf 101 moves from the home position, where the shelf 101 is stored below the support plate 67, along the direction of projecting from the support plate 67 (refer to arrow N1 in the figure) while receiving the drive from the driving unit 107. At this time, the claw portion main body 111 is released from restriction by the support plate 67, to thereby adopt the standing attitude. Further, the shelf 101 comes to the second position where the claw portion main body 111 is separated from the tip end of the support plate 67 (refer to FIG. 6B).

After the shelf 101 is located to the second position as shown in FIG. 6C, the sheets P are supplied to the support plate 67. Then, every time a single sheet P is supplied, the shelf 101 extends and contracts. In other words, by changing the position of (moving by sliding) the shelf 101 between the first position and the second position, the claw portion main body 111 projects against or retracts from the sheet P. The claw portion main body 111 pushes the end portion of the sheet P on the downstream side in the transport direction, to thereby place the sheet P to the end guide 64 (press the sheet P against the end guide 64). This accumulates the sheets P, with the end portions thereof being aligned, on the top surface of the support plate 67, and thereby the bundle of sheets P is formed.

Next, the staple-stitching is performed on the bundle of sheets P formed on the support plate 67 by the stapler head 51. Then the bundle of sheets P to which the staple stitching has been applied is outputted to the first stacking portion 43 (refer to FIG. 2) by the transport roll (refer to FIG. 2). Moreover, after the bundle of sheets P passed through a predetermined position, storage of the shelf 101 below the support plate 67 is started (refer to arrow N2 in the figure). It should be noted that the storage of the shelf 101 below the support plate 67 is completed before the trailing edge of the bundle of sheets P outputted from the support plate 67 passes through the tip end of the support plate 67.

Consequently, for example, even in a case where the difference in height between the tip end of the support plate 67 and a part of the first stacking portion 43 on which the bundle of sheets P is stacked is large, the trailing edge of the bundle of sheets P is caused to directly fall from the tip end of the support plate 67 onto the first stacking portion 43 while the leading edge of the bundle of sheets P to be outputted is prevented from hanging. In other words, the time to start and complete the operation of storing the shelf 101 below the support plate 67 is determined so as to maintain an attitude of the bundle of sheets P when the shelf 101 outputs the bundle of sheets P to the first stacking portion 43.

Moreover, in the specific example shown in the figure, the claw portion main body 111 in the standing state contacts the leading edge of the bundle of sheets P to be outputted. At this time, the claw portion main body 111 is put down by being pressed by the leading edge of the bundle of sheets P, and is brought into a state of being stored in the recessed portion 102 of the shelf 101 (refer to FIG. 6C). On this claw portion main body 111 stored in the recessed portion 102, it becomes possible to transport the bundle of sheets P.

By the way, as described above, the shelf 101 includes the claw portion 110, to thereby perform alignment of the sheets P while supporting the sheets P in the exemplary embodiment. Accordingly, the shelf 101 and the claw portion 110 may be considered as a configuration for performing alignment of the sheets P while controlling the attitude of the sheets P.

Moreover, for example, in comparison with a configuration including a so-called paddle that is, instead of the claw portion 110, provided rotatably above the support plate 67 to transport the sheet P while intermittently contacting the surface of the sheet P to scratch and return thereof, the exemplary embodiment that presses the end portion of the bundle of sheets P laterally from thereof is capable of improving the accuracy in aligning the end portion of the bundle of sheets P. Further, the exemplary embodiment is capable of reducing the time required for aligning. Moreover, in the exemplary embodiment, since the operation for aligning the sheets P on the support plate 67 is performed from laterally thereof, it is unnecessary to provide an aligning member above the support plate 67. Accordingly, in the exemplary embodiment, flexibility in layout above the support plate 67 is high.

Modified Embodiment

Next, with reference to FIG. 7, a modified embodiment of the exemplary embodiment will be described. It should be noted that FIG. 7 is a diagram for illustrating the modified embodiment.

First, in the above-described exemplary embodiment, description that the claw portion 110 includes the torsion spring 115 and the claw portion main body 111 is rotated by the elastic force of the torsion spring 115 was given; however, other configurations may be allowed as long as the claw portion main body 111 is rotatable between the standing attitude from the shelf 101 and the lying attitude.

Figure 7:
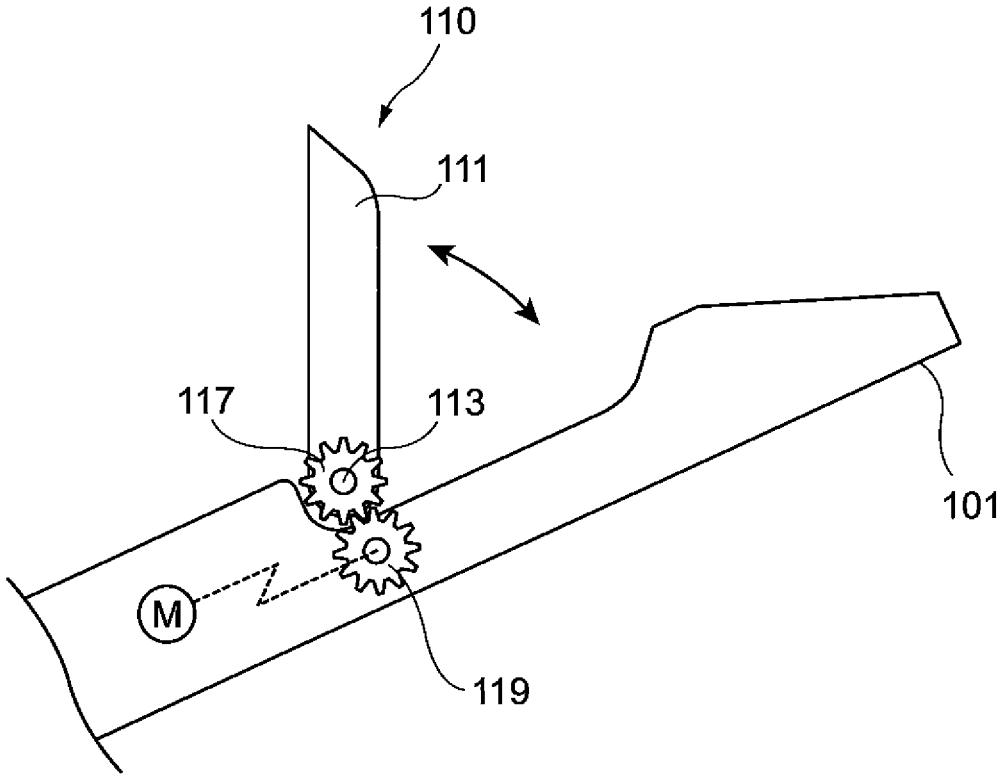
FIG. 7 is a diagram for illustrating a modified embodiment.

For example, as shown in FIG. 7, there may be a configuration in which the claw portion 110 includes a rotational gear 117 provided around the rotational axis 113, a driving gear 119 that drives the rotational gear 117 and a driving motor M that supplies a driving force to the driving gear 119. Upon receiving the driving force from the driving motor M, the claw portion main body 111 is switched between the standing attitude and the lying attitude.

It should be noted that the rotational gear 117 may have a configuration of being rotated by drive of the shelf motor 107*a* (refer to FIG. 3). Moreover, in the specific example shown in the figure, the sheets P may be aligned by rotation of the claw portion main body 111 around the rotational axis 113 upon receiving the driving force of the driving motor M while continuing to stop the shelf 101 in the projecting state.

Moreover, in the above-described exemplary embodiment, configuration in which the claw portion 110 pressed the bundle of sheets P was described; however, for example, there may be a configuration in which the shelf 101 provided with no claw portion 110 presses the bundle of sheets P. To be described further, though illustration is omitted, there may be another configuration in which the shelf 101 includes a bending portion that extends in the direction intersecting the transport direction of the sheets P and bends, and a torsion spring that rotates an end portion of the shelf 101 on the tip end side around the bending portion, the torsion spring flips up the end portion of the shelf 101 on the tip end side around the bending portion in the state where the shelf 101 projects from the support plate 67, and accordingly, the end portion of the shelf 101 on the tip end side having been flipped presses the bundle of sheets P against the end guide 64.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment as chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a stacking section that stacks a sheet;

an output section that outputs the sheet stacked on the stacking section;

a facing section that is arranged to face an end portion of the stacked sheet on an upstream side in an output direction;

a movable support section that is provided to be movable from the stacking section toward a downstream side in the output direction of the stacked sheet, and when the stacked sheet is outputted from the stacking section, supports the stacked sheet with the stacking section;

a pressing section that is (i) provided on a surface of the movable support section to face an end portion of the stacked sheet on the downstream side in the output direction, and (ii) stored in a storage section of the moveable support section when the pressing section is positioned below a stacking surface; and a driving section that drives the movable support section (i) to move toward the upstream side in the output direction as the sheet stacks on the stacking section and (ii) to thereby press the stacked sheet against the facing section with the pressing section, wherein, when an end portion of the movable support section is drawn below the stacking section, an end portion of the pressing section on the downstream side in the output direction is positioned under the stacking section.

2. The post-processing device according to claim 1, further comprising:

a retracting mechanism that retracts the pressing section from an output route of the stacked sheet when the stacked sheet is outputted from the stacking section.

3. The post-processing device according to claim 1, wherein a top surface of the pressing section stored in the storage section is arranged to be along the stacking surface of the movable support section.

4. The post-processing device according to claim 1, further comprising:

an urging section that urges the pressing section to stand up from the movable support section, and when the stacked sheet is outputted from the stacking section, causes the pressing section having stood up to be pushed by the stacked sheet and to fall in a separating direction from the stacked sheet.

5. The post-processing device according to claim 1, wherein the pressing section comprises a plate-shaped member that is retractable with respect to a transport route of a bundle of sheets.

6. The post-processing device according to claim 1, wherein when an end portion of the movable support section is drawn below the stacking section, the pressing section is stored in the storage section, wherein when the movable support section and the pressing section project from the stacking section, the pressing section adopts a standing attitude due to an elastic force of an elastic member, and wherein when the pressing section is in the standing attitude, the movable support section moves between a first position where the pressing section abuts a tip end of the stacking section and a second position where the pressing section is at a greater distance from the tip end of the stacking section than the first position.

7. The post-processing device according to claim 1, wherein, when the end portion of the movable support section is drawn below the stacking section, the entire pressing section is positioned (i) under the stacking section and (ii) upstream in the output direction of an end portion of the stacking section on the downstream side in the output direction.

8. An image forming system comprising:

an image forming section that forms an image on a sheet;

a transport section that transports the sheet on which the image has been formed by the image forming section;

a stacking section that stacks the sheet transported by the transport section;

an output section that outputs the sheet stacked on the stacking section;

a facing section that is arranged to face an end portion of the stacked sheet on an upstream side in an output direction;

a pressing section that moves toward the upstream side in the output direction as the sheet stacks on the stacking section to press the stacked sheet against the facing section from the downstream side in the output direction of the stacked sheet, and when the stacked sheet is outputted from the stacking section, supports the stacked sheet with the stacking section; and a moveable support section, wherein the movable support section comprises:

the pressing section provided on a surface of the movable support section; and a storage section that stores the pressing section when the pressing section is positioned below a stacking surface, wherein, when an end portion of the movable support section is drawn below the stacking section, an end portion of the pressing section on the downstream side in the output direction is positioned under the stacking section.

9. The image forming system according to claim 8, wherein, when the end portion of the movable support section is drawn below the stacking section, the entire pressing section is positioned (i) under the stacking section and (ii) upstream in the output direction of an end portion of the stacking section on the downstream side in the output direction.

10. A post-processing device comprising:

a stacking section that stacks a sheet;

an output section that outputs the sheet stacked on the stacking section;

a facing section that is arranged to face an end portion of the stacked sheet on an upstream side in an output direction;

a movable support section that is provided to be movable from the stacking section toward a downstream side in the output direction of the stacked sheet, and when the stacked sheet is outputted from the stacking section, supports the stacked sheet with the stacking section;

a pressing section that is (i) provided on a surface of the movable support section to face an end portion of the stacked sheet on the downstream side in the output direction, and (ii) stored in a storage section of the movable support section when the pressing section is positioned below a stacking surface, wherein when the pressing section is in a standing attitude, a controller controls the movable support section to move between a first position where the pressing section abuts a tip end of the stacking section and a second position where the pressing section is at a greater distance from the tip end of the stacking section than the first position; and a driving section that drives the movable support section (i) to move toward the upstream side in the output direction as the sheet stacks on the stacking section and (ii) to thereby press the stacked sheet against the facing section with the pressing section.

11. The post-processing device according to claim 10, further comprising:

a retracting mechanism that retracts the pressing section from an output route of the stacked sheet when the stacked sheet is outputted from the stacking section.

12. The post-processing device according to claim 10, wherein a top surface of the pressing section stored in the storage section is arranged to be along the stacking surface of the movable support section.

13. The post-processing device according to claim 10, further comprising:

an urging section that urges the pressing section to the standing attitude, and when the stacked sheet is outputted from the stacking section, causes the pressing section in the standing attitude to be pushed by the stacked sheet and to fall in a separating direction from the stacked sheet.

14. The post-processing device according to claim 10, wherein when an end portion of the movable support section is drawn below the stacking section, the pressing section is stored in the storage section, and wherein when the movable support section and the pressing section project from the stacking section, the pressing section adopts the standing attitude due to an elastic force of an elastic member.

15. The post-processing device according to claim 10, wherein the pressing section comprises a plate-shaped member that is retractable with respect to a transport route of a bundle of sheets.

16. The post-processing device according to claim 10, wherein when an end portion of the movable support section is drawn below the stacking section, an end portion of the pressing section on the downstream side in the output direction is positioned under the stacking section.

17. An image forming system comprising:

an image forming section that forms an image on a sheet;

a transport section that transports the sheet on which the image has been formed by the image forming section;

a stacking section that stacks the sheet transported by the transport section;

an output section that outputs the sheet stacked on the stacking section;

a facing section that is arranged to face an end portion of the stacked sheet on an upstream side in an output direction;

a pressing section that moves toward the upstream side in the output direction as the sheet stacks on the stacking section to press the stacked sheet against the facing section from the downstream side in the output direction of the stacked sheet, and when the stacked sheet is outputted from the stacking section, supports the stacked sheet with the stacking section; and a moveable support section, wherein the movable support section comprises:

the pressing section provided on a surface of the movable support section; and a storage section that stores the pressing section when the pressing section is positioned below a stacking surface, wherein when the pressing section is in a standing attitude, a controller controls the movable support section to move between a first position where the pressing section abuts a tip end of the stacking section and a second position where the pressing section is at a greater distance from the tip end of the stacking section than the first position.

18. The image forming system according to claim 17, wherein when an end portion of the movable support section is drawn below the stacking section, an end portion of the pressing section on the downstream side in the output direction is positioned under the stacking section.

* * * * *